US008721463B2

(12) United States Patent
Zambelli

(10) Patent No.: US 8,721,463 B2
(45) Date of Patent: May 13, 2014

(54) AMUSEMENT RIDE WITH TONNEAU MOVEMENT

(75) Inventors: Giambattista Zambelli, Ceneselli (IT); Fiorella Viarana, legal representative, Ceneselli (IT)

(73) Assignee: Antonio Zamperla S.p.A., Altavilla Vicentina (VI) (IT)

( * ) Notice: Subject to any disclaimer, the term of this patent is extended or adjusted under 35 U.S.C. 154(b) by 172 days.

(21) Appl. No.: 13/386,811

(22) PCT Filed: Nov. 15, 2010

(86) PCT No.: PCT/IB2010/002921

§ 371 (c)(1),
(2), (4) Date: Jan. 24, 2012

(87) PCT Pub. No.: WO2011/061594

PCT Pub. Date: May 26, 2011

(65) Prior Publication Data

US 2012/0190463 A1 Jul. 26, 2012

(30) Foreign Application Priority Data

Nov. 17, 2009 (WO) ..... PCT/IB2009/007489

(51) Int. Cl.
*A63G 1/26* (2006.01)
*A63G 27/04* (2006.01)

(52) U.S. Cl.
USPC ..... 472/31; 472/33

(58) Field of Classification Search
USPC ..... 472/29, 31–33, 39, 45, 46
See application file for complete search history.

(56) References Cited

U.S. PATENT DOCUMENTS

| | | | | |
|---|---|---|---|---|
| 2,294,166 A | | 8/1942 | Eyerly | |
| 2,362,190 A | | 11/1944 | Cortes | |
| 5,395,290 A | * | 3/1995 | Knijpstra | 472/31 |
| 6,022,276 A | * | 2/2000 | Knijpstra | 472/33 |

FOREIGN PATENT DOCUMENTS

| | | |
|---|---|---|
| DE | 34 31 684 | 3/1986 |
| DE | 91 04 204 | 6/1991 |
| DE | 42 22 850 | 1/1994 |

OTHER PUBLICATIONS

International Search Report, issued in corresponding International Application No. PCT/IB2009/007489.
Written Opinion, issued in corresponding International Application No. PCT/IB2009/007489.
International Search Report, issued in corresponding International Application No. PCT/IB2010/002921.
Written Opinion, issued in corresponding International Application No. PCT/IB2010/002921.
International Preliminary Report on Patentability and Written Opinion, issued in corresponding International Application No. PCT/IB2010/002921.

* cited by examiner

*Primary Examiner* — Kien Nguyen
(74) *Attorney, Agent, or Firm* — Kenyon & Kenyon LLP

(57) ABSTRACT

A roundabout for performing acrobatic figures such as barrel roll comprises a main arm rotatable around a central axis A and having a longitudinal axis C, a second arm rotatable about an axis of rotation B perpendicular to the longitudinal axis C of the main arm, and a vehicle fixed on the second arm at a distance from the axis of rotation B of the second arm and having a longitudinal axis z directed radially towards the axis of rotation B. The vehicle is fixed to the second arm so that its position with respect to the second arm does not change during the operation of the roundabout.

13 Claims, 7 Drawing Sheets

AMUSEMENT RIDE WITH TONNEAU MOVEMENT

CROSS-REFERENCE TO RELATED APPLICATIONS

The present application is the National Stage of International Application No. PCT/IB2010/002921, filed Nov. 15, 2010, and claims priority to International Application No. PCT/IB2009/007849, filed Nov. 17, 2009, the entire contents of each of which are expressly incorporated herein by reference.

FIELD OF INVENTION

The present invention relates to a roundabout of the type used, for example, in amusement parks or in theme parks. In particular, the present invention relates to a roundabout in which one or more vehicles, for transporting passengers, are moved by a plurality of arms set in rotation by respective motors along a spiral path that corresponds to the air-acrobatics figure known as "barrel roll" or "tonneau."

BACKGROUND INFORMATION

The term "roundabout" is intended herein to indicate an amusement device normally present in fair grounds, amusement parks, and similar places, without the description being limited to the classic "carousel" structure of the roundabout itself.

In the roundabout sector, there is a constant search for developing machines capable of arousing new and more intense sensations for users achieved by new geometries of the structures of the machines themselves. Moreover, the search referred to above will privilege machines that enable simulation of possible extreme real situations, such as for example piloting an aeroplane.

Various known embodiments of roundabouts are provided with arms bearing one or more vehicles that are made to rotate with the arm to simulate the flight of an aeroplane. The roundabouts envisage a stationary central column and one or two arms which are able to turn in a vertical plane. Each arm carries at its end a spaceship or vehicle, namely, a device for accommodating users (passengers) which can turn on itself. An example of said embodiments is provided by the Technical Park and is illustrated in FIG. 7. This type of embodiment, with or without interactive control of the drives of the vehicle, leads to unnatural movements that subject the passengers to combinations of unpleasant accelerations. In practice, the sensations aroused in the passengers in known embodiments substantially depend upon the circular motion of the vehicles carried by the arms and are thus relatively limited.

Other examples of roundabouts are disclosed in German Patent Application Nos. DE 42 22 850 A1 and DE 91 04 204 U1. For example, German Patent Application No. DE 42 22 850 A1 discloses a roundabout in which a plurality of cantilevered arms are rotatable around a vertical column. At the end of each arm, there is rotatably mounted a bar having at its end a vehicle for passengers. The vehicles are mounted on the bar in such a way that they are free to rotate with respect to it. For this reason, during the rotation of main arms and of the bars with respect to them, the vehicles are subjected to irregular and chaotic oscillations, which lead to unpleasant and possibly dangerous movements.

In addition, German Patent Application No. DE 91 04 204 U1 relates to a roundabout of the type comprising cantilevered arms on which are rotatably mounted first bars having second bars mounted on their ends. At the ends of the second arms are rotatably supported vehicles for passengers. This type of roundabout has many degrees of freedom and many possibilities of relative movements of each part with respect to the others resulting, also in this case, in random movements that subject the passengers to combinations of unpleasant accelerations.

An object of the present invention is to solve the problems set forth above and provide a safe and reliable roundabout, which is able to create new sensations in users. It is another object of the present invention to provide a roundabout that can simulate a "tonneau" movement of an airplane.

SUMMARY OF THE INVENTION

The above objects are achieved by the present invention, which provides a roundabout of the type comprising at least one main arm, which is mobile along a path by at least one motor, and one or more vehicles having a longitudinal axis z, which are mobile with said arm along said path, said main arm having a longitudinal axis C, at least one second arm, said at least one vehicle being constrained on said second arm in a position at a distance from the axis of rotation B of said second arm with respect to said at least one main arm.

The roundabout according to the present invention further comprises an actuator for rotating said one or more second arms about an axis of rotation B perpendicular to the longitudinal axis C of said at least one main arm in order to rotate said vehicles along a circular path in a plane P perpendicular to axis of rotation B.

In the roundabout according to the present invention, the longitudinal axis z of said at least one vehicle is directed radially, or substantially radially, towards said axis of rotation B and at least one vehicle is fixed to second arm so that the position of said vehicle with respect to said second arm does not change during the operation of said roundabout.

In other words, the present invention provides a roundabout that has a mechanism capable of imparting on the vehicles, and on the passengers accommodated therein, a path that is at least in part spiral and preferably capable of subjecting the passengers to a Coriolis force. For this purpose, a preferred embodiment of the present invention envisages that the first arm, or main arm, is set in rotation about a central hub, in a horizontal plane, and that a second arm is provided, hinged in such a way as to be able to rotate about the axis B on the first arm and on which one or more vehicles are fixed in a position at a distance from the point of rotation of the second arm with respect to the main arm, the axis of rotation B consequently being tangential to the circular path followed by the arms, for example by their ends. Other structure for support and rotation of the vehicles may be used instead of a second arm, such as for example a disk.

Moreover, according to the present invention, the vehicles are fixed on the second arm, i.e. the vehicles are attached to the second arm in such a way that they cannot rotate or translate with respect to the second arm. Thus, the position of the vehicle with respect to the second arm does not change during the operation of the roundabout.

Furthermore, the longitudinal axis z of the vehicle is directed radially towards the axis of rotation B of the second arm with respect to the main arm, and does not change its orientation during the operation of the roundabout according to the present invention.

Advantageously, the combination of the motion of rotation of the main arms and of rotation of the second arms with respect thereto, about an axis B that is perpendicular to the longitudinal axis C of the main arms, brings about an effect of overall movement that is able to subject the user to accelerations having variable intensity and direction that are particularly pleasant and exciting.

For example, in the roundabout according to the present invention, by complete rotation of the second arm with respect to the main arms, which are also set in rotation by the fixed motor, the vehicles perform loops (i.e., complete rotations), and it is possible to simulate the maneuver of acrobatic flight commonly known as "barrel roll" or "tonneau."

According to a preferred embodiment, the actuator, i.e. a motor, of the second arm is able to get the vehicles to make at least one complete turn with respect to the axis of rotation B to obtain a "tonneau," as previously mentioned, and the vehicles are fixed with respect to the second arm.

Moreover, during the complete rotation of second arm with respect to the main arm, the vehicles and the passengers accommodated therein are subjected to an acceleration directed along the longitudinal axis z of the vehicle which is greater than or equal to zero.

The two arms are sized so as not to interfere with one another and generally the second arms are shorter than the main arms.

Generally, the main arm has a length comprised between 3 m and 20 m, more preferably between 4 m and 16 m, and even more preferably between 5 m and 10 m. The second arm has a length comprised between 2 m and 15 m, preferably between 3 m and 6 m, and more preferably between 4 m and 5 m.

The roundabout according to the present invention further comprises a device for controlling the movement of the arms that preferably comprise an encoder for detecting the relative position between the second arm and the main arm.

In a preferred embodiment of the roundabout according to the present invention, then, the movement of the vehicle or vehicles in space occurs on a toroidal surface. A further object of the present invention is the use of a roundabout according to any one of the preceding claims for carrying out simulation of the maneuver of acrobatic flight called "barrel roll" or "tonneau."

A further object of the present invention is a method for operating a roundabout, characterized in setting in rotation with respect to a vertical axis A at least one first main arm having a longitudinal axis C and being directed radially with respect to said vertical axis of rotation A, and simultaneously imposing complete rotation of at least one vehicle fixed to a second arm with respect to said at least one main arm about an axis of rotation B of said second arm, perpendicular to said longitudinal axis C of said at least one main arm, said at least one vehicle being supported at a distance from said axis of rotation B, and being set in rotation along a circular path in a plane P perpendicular to said axis of rotation B and wherein the position of the vehicle with respect to the second arm does not change during the operation of said roundabout.

Advantageously the method according to present invention generates acceleration along the longitudinal axis z of the vehicle, and also on the passengers accommodate therein, which is greater than or equal to zero.

Thus the passenger is subjected to new, particular and exciting sensations.

BRIEF DESCRIPTION OF THE DRAWINGS

The present invention will now be described in greater detail with reference to the accompanying drawings provided purely by way of illustrative and non-limiting example.

DETAILED DESCRIPTION

Figure 1:
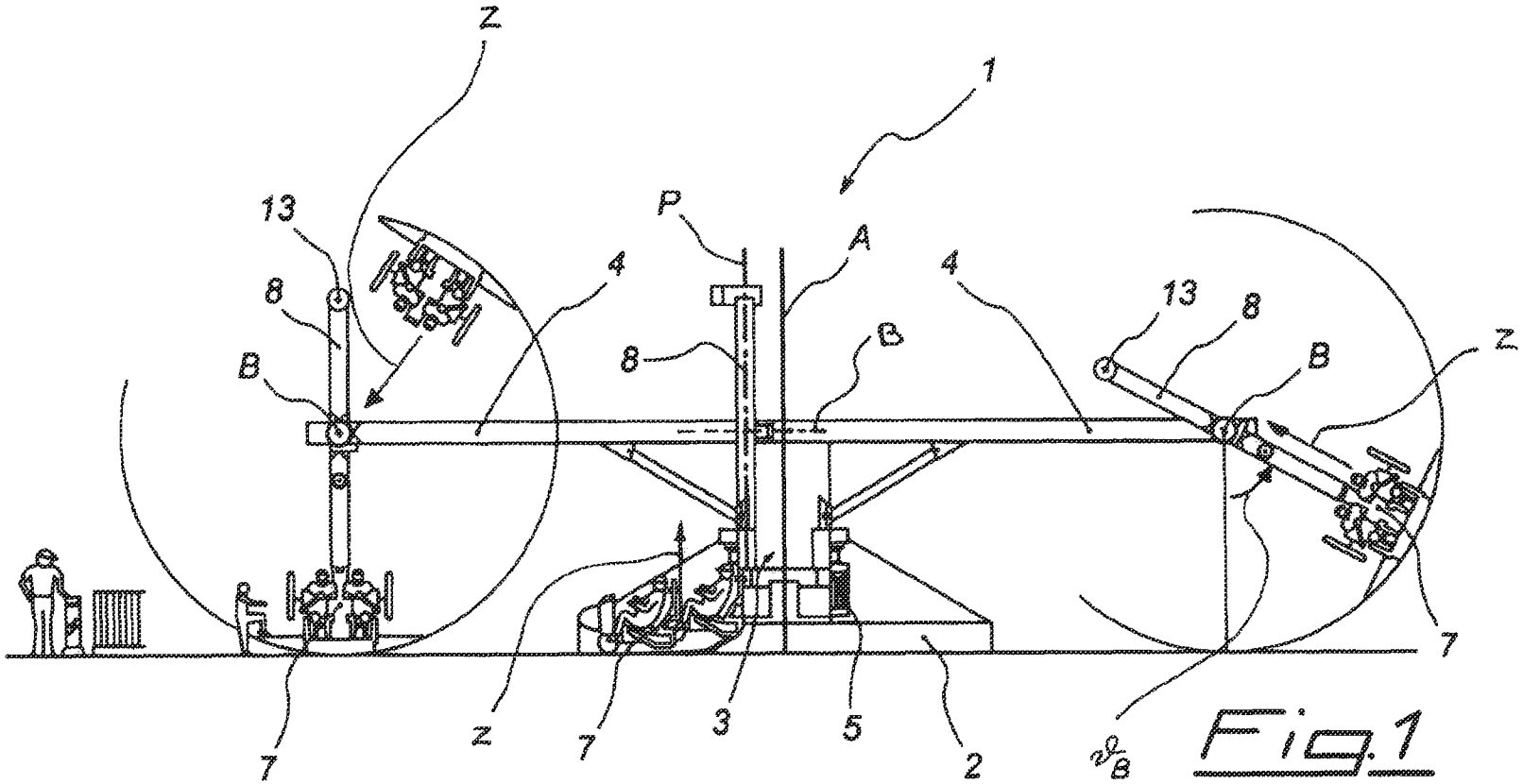
FIG. 1 is a front view of the roundabout according to the present invention.

Generally, the roundabout of the present invention comprises a main arm 4 rotatable around a central axis A and having a longitudinal axis C, a second arm 8 rotatable about an axis of rotation B perpendicular to the longitudinal axis C of the main arm, a vehicle fixed on the second arm 8 at a distance from the axis of rotation B of the second arm and having a longitudinal axis z directed radially towards the axis of rotation B; the vehicle being fixed to the second arm 8 so that its position with respect to the second arm 8 does not change during the operation of the roundabout.

For example, the roundabout 1 according to the present invention comprises at least one main arm 4 having a longitudinal axis C, which is mobile along a path by at least one motor 5, one or more vehicles 7 mobile with said arm along the path, and at least one second arm 8 rotatable about an axis of rotation B perpendicular to the longitudinal axis C of the main arm, and substantially horizontal. The expression "substantially horizontal" is intended to indicate that the inclination of the axis of rotation B with respect to the ground is comprised between +30° and −30°, preferably between +12° and −12°, and more preferably that the axis of rotation B is parallel to the ground.

The vehicles 7 are mounted on the main arm 4 through a second arm 8 that supports them at a distance from the axis of rotation B. In this way, the vehicles are set in rotation along a circular path in a plane P that is perpendicular to the axis of rotation B.

Figure 4:
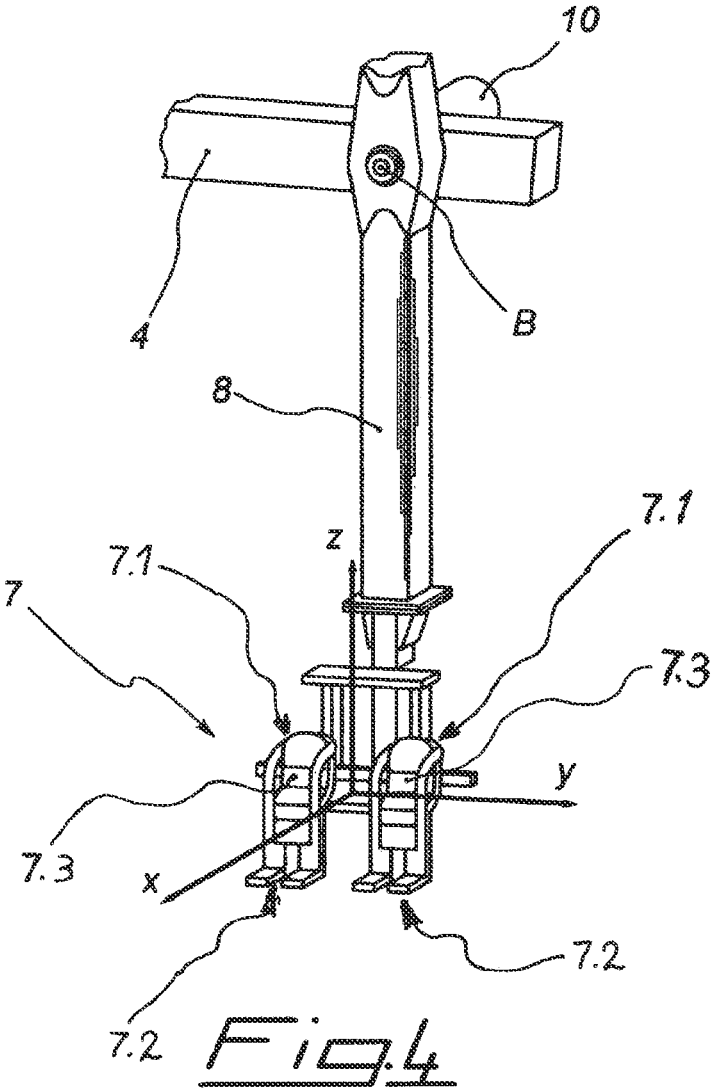
FIG. 4 is a view in detail of a vehicle of the roundabout according to the present invention.

FIG. 4 depicts a reference system x-y-z fixed with respect to the vehicle 7, having as origin the centre of gravity of the vehicle itself. The longitudinal axis z of the vehicle 7 is directed radially towards the axis of rotation B. As shown in FIG. 4, when the vehicle is stopped, axis z is the vertical axis of the reference system.

Generally, the longitudinal axis z corresponds, or is substantially parallel, to the backrest 7.3 of the vehicle which has an elongated form substantially extending between the headrest area 7.1 and the footrest area 7.2 of the vehicle.

As previously mentioned, the vehicles are fixed to the arm, either directly or indirectly, so that their position does not change with the operation of the apparatus and axis z remains directed radially to rotation axis B, as shown in FIG. 1.

The combined movement of the main arm 4 and of the second arm 8 is able to impart on the fixed vehicle or vehicles a path that is at least in part helical and, following upon a complete rotation of 360° of the vehicle or vehicles about the axis B, the roundabout enables simulation of the maneuver of the acrobatic flight commonly called "barrel roll," in which the aircraft describes a helical path with respect to its direction of advance.

As will be disclosed later, the complete rotation of 360° of the vehicle or vehicles 7 about the axis B also allows the generation of, on the users (passengers) carried in the vehicle, accelerations along the longitudinal axis z of the vehicle which are greater than or equal to zero.

By the term "vehicle," it is here meant a device that is suitable for housing passengers and holding them in a condition of safety. For example, by the term "vehicle," it is meant a seat, or a group of seats equipped with appropriate safety measures, for example belts or mobile barriers shaped in such a way as to block in the seat the user who is being carried.

For example, as shown in FIG. 4, the vehicle 7 is generally provided with a backrest 7.3 in order to provide a safety support for the back of one or more users.

Vehicles 7 are provided with a headrest area 7.1 and a footrest area 7.3 respectively corresponding to the areas where the head and the foot of the user are located during the operation of the roundabout.

Preferably, the headrest area 7.1 is located in such a way that it is closer to the axis of rotation B than the footrest area 7.2. The vehicle headrest area 7.1 is located closer to the axis of rotation B than the footrest area 7.2.

Figure 2:
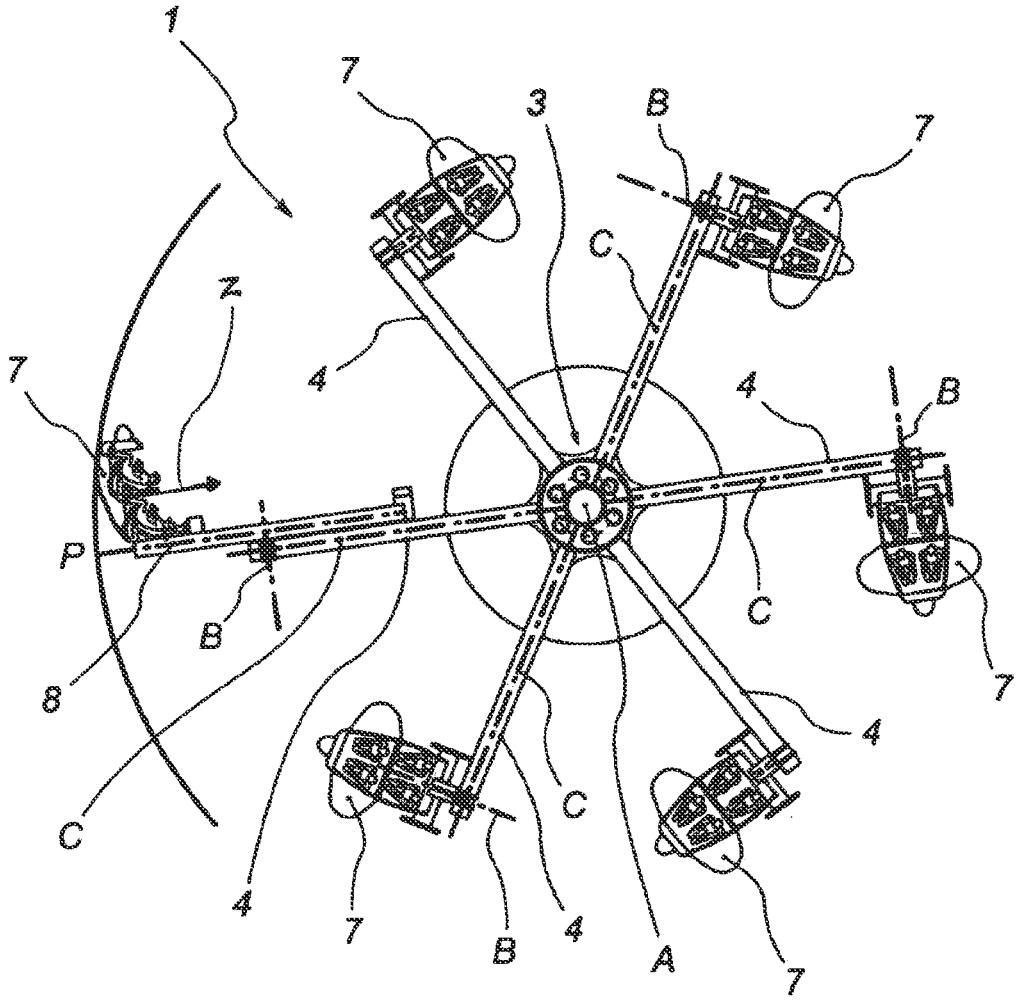
FIG. 2 is a plan view of the roundabout according to the present invention.

FIGS. 1 and 2 show, respectively, a front view and a plan view of one embodiment of roundabout according to the characteristics of the present invention.

As may be seen in FIG. 1, the roundabout 1 comprises a fixed base 2, rotatably mounted on which, for example by a bearing or equivalents known for said use, is a portion 3, having a cross section with polygonal base, constrained to which is a plurality of main arms 4.

In the figure, four main arms 4 are constrained to the rotatable polygonal portion 3. The number of arms can be different and in further exemplary embodiments of the roundabout, six, seven or eight main arms 4 are present.

A motor 5, that in the shown embodiment is mounted on fixed base 2, sets in rotation, along a vertical axis of rotation A, the rotatable polygonal portion 3, and hence the main arms 4 constrained thereto. The main arms have a length comprised between 3 m and 20 m, preferably between 4 m and 16 m, and more preferably between 5 m and 10 m.

In the embodiment represented in FIGS. 1 and 2, the main arms 4 have a length of approximately 7.5 m and are set in rotation by the motor 5 at a rate of approximately 7 rpm.

As shown in FIG. 1, the main arms 4 extend radially with respect to the vertical axis A and are rotated with respect thereto by the motor 5, according to a circular path in a substantially horizontal plane (namely, a plane substantially parallel to the ground).

Figure 3:
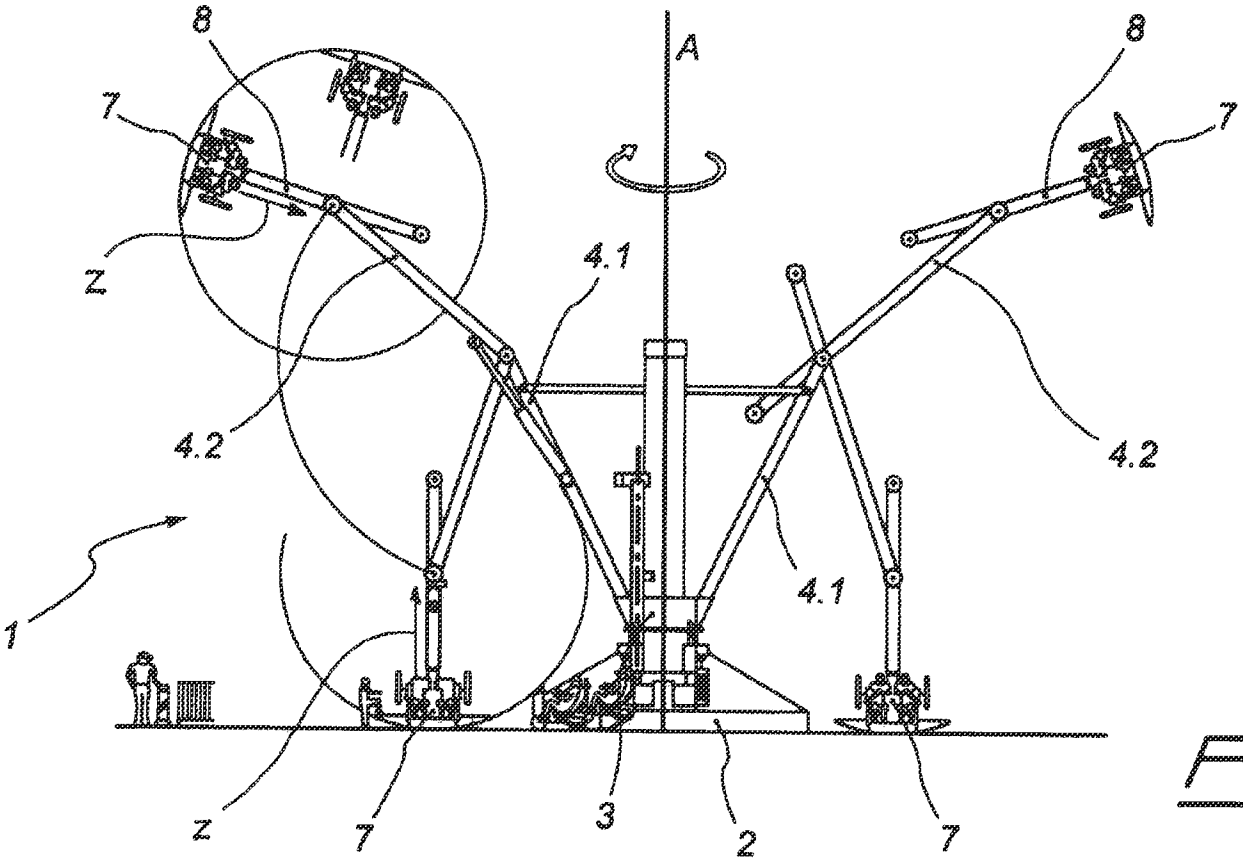
FIG. 3 is a front view of a second exemplary embodiment of the roundabout according to the present invention.

Arms 4 are a single piece, as in the embodiment illustrated in FIGS. 1 and 2, or else can comprise a number of parts constrained to one another, as in the further exemplary embodiment of the roundabout illustrated in FIG. 3.

FIG. 3 shows a roundabout having characteristics that are the same as the ones already described so far with reference to FIGS. 1 and 2, with the sole exception of the main arms 4, which are constituted by two parts 4.1 and 4.2, constrained to one another.

The first part 4.1, is constrained to the rotatable portion 3, whilst the second part 4.2 is able to rotate in a controlled way with respect to the first by a hydraulic or pneumatic actuator, or equivalent actuator. Second arm 8 is mounted on second part 4.2. In this embodiment, once the second part 4.2 has been raised with respect to the first, the movement of rotation of the vehicles and second arm 8 about the axis B occurs at a greater height than in the embodiment of FIGS. 1 and 2.

As mentioned, the roundabout according to the present invention comprises one or more vehicles 7, which are designed to carry one or more users, and one or more second arms 8 intended to support the vehicle or vehicles 7 and setting them in rotation about an axis of rotation B that is perpendicular to the longitudinal axis C of the main arms 4, as shown in FIG. 2.

The actuator for rotating said second arm 8 with respect to the main arms 4 preferably comprises a motor 10 mounted on main arm 4, which enables, via appropriate members for transmission of the motion, for example, gears, setting in rotation, in the desired way, of the second arm 8 with respect to the main arm 4 about the axis B.

As already mentioned above, vehicles 7 for transporting passengers, are fixed on the second arm 8 in such a way as to be at a distance from the axis of rotation B of the second arm with respect to the main arm 4.

By so doing, the vehicle or vehicles constrained to the second arms 8, rotate about the axis of rotation B, following a circular path in the plane P. In fact, as may be seen in FIGS. 1 and 2, the second arm 8 can rotate completely with respect to the main arm 4 about the axis of rotation B, which, as has been previously stated, is orthogonal to the longitudinal axis C of the main arm 4.

The plane P in which the circular motion of the vehicles is performed is perpendicular to the axis of rotation B, and hence, according to a preferred embodiment, is vertical with respect to the ground. In addition, the vehicle 7 during the motion of circular rotation with respect to the axis B varies its distance with respect to the axis A of rotation of the main arms 4.

Alternatively, the plane P may be inclined with respect to the vertical (for example, the vertical axis A) by an angle comprised between +30° and −30°, preferably between +10° to −10°, and more preferably between +5° to −5°. In any case, the vehicles are fixed to second arm 8 with axis z radially directed to rotation axis B and their position during the operation of the roundabout does not change with respect to second arm 8. In this way the acceleration along axis z of the vehicle, during at least part of the complete loops, is equal to or greater than zero ($a_z \geq 0$). The vehicle headrest area 7.1 is located closer to the axis of rotation B than the footrest area 7.2, so that an ideal "feet-head" axis is radial to rotation axis B and directed to said axis.

As may be seen in FIG. 2, the axis of rotation B of the second arms 8 with respect to the main arms 4 is tangential to the circular path described by the ends of the main arms 4.

Likewise, in the exemplary embodiment of FIG. 3, the axis of rotation B of the second arms 8 with respect to the main arms 4 is tangential to the circular path described by the end of the second part 4.2 of the main arms 4.

It is moreover to be noted that, in other exemplary embodiments of the roundabout, the structure for supporting the vehicle or vehicles 7 and setting them in rotation comprises, for example, a disk lying in the plane P and having its own centre coinciding with the axis of rotation B, on which the vehicles are constrained in a position distant from the axis of rotation B.

The roundabout according to the present invention further comprises a device for controlling the rotation movement of the second arms 8 with respect to the main arms 4 about the axis of rotation B.

The vehicles 7 are fixed to the second arm 8, which puts them in rotation about the axis of rotation B by a motor 10 for adjusting the relative position between said second arm 8 and said main arm 4.

In other words, the vehicles 7 are fixed on the second arm 8 and are unable to move with respect thereto during rotation about the axis B. According to a preferred embodiment of the present invention, vehicles 7 are fixed to the second arm 8 in such a way that, when they reach the ground, the users can climb on board. Because the vehicle 7 is fixed on the second arm 8 with its longitudinal axis z directed radially towards the axis of rotation B of the second arm 8 with respect to the main arm 4, this means that, upon rotation of the second arm with respect to the first, the vehicle will reach positions in which the users are set upside down, i.e., with their heads facing the ground and their feet facing upwards.

Preferably, the backrest 7.3 of the seat of the vehicle 7, that is the longitudinal axis of backrest 7.3, corresponds, or is substantially parallel, to the longitudinal axis z of the vehicle in such a way that the "foot-head" line, i.e. the back or spine, of the passenger is also directed radially towards the axis of rotation B of the second arm 8 with respect to the main arm 4.

In the embodiment shown in FIGS. 1 to 3, the second arm 8 has a vehicle 7 constrained at one end thereof, whereas a counterweight 13 is mounted at the other end.

Said counterweight 13 is sized in such a way that the centre of gravity of the second arm 8 will be in the arm 8 portion comprised between the point of rotation with respect to the main arm 4 and the vehicle 7.

By so doing, when the roundabout is stationary, the vehicle 7 tends, by itself, to reach a position close to the ground, i.e., it tends to assume a vertical position when it reaches the ground to enable the passengers to climb in and out, as shown in the left part of FIG. 1.

The second arm 8 has maximum overall dimensions defined starting from the point of rotation of the latter with respect to the main arm 4, i.e., the length of the radius of the circular path that the vehicle performs in the plane P, comprised in the interval between 2 m and 15 m, preferably between 3 m and 6 m, and more preferably between 4 m and 5 m. The dimensions of the second arm 8 are strictly correlated and depend upon the overall dimensions of the roundabout itself, and in particular upon the length of the main arms 4.

In the exemplary embodiment of FIGS. 1 and 2, second arm 8 has maximum overall dimensions of approximately 4 m, the main arm having one of approximately 7.5 m. In any case the respective lengths must be such as to enable arm 8 to carry out complete rotations (360°) around axis B.

In particular, the combination of the motion of rotation of the main arms about the vertical axis A and of the motion of rotation of the second arm 8 with respect to the main arm 4 about the axis B, enables a range of movement in space of the vehicles that coincides with a toroidal, or doughnut-shaped, surface.

The control of the movement of the vehicles occurs by acting on the motor 5 designed to set the rotatable polygonal portion 3 and hence the main arms 4 in rotation about the vertical axis A, and by acting on the second motor 10 for controlling the movement of the second arms 8 with respect to the main arms 4 along the axis of rotation B, as shown in FIGS. 1 and 2.

The control of the movement can be carried out by pre-set programs in a control unit, with which the roundabout is equipped (not shown in the attached figures), or else according to criteria of interactivity, allowing the passenger to decide on the direction of the movement, or according to a mixed programmed and interactive scheme.

The combination of the movements, and hence control of the speed of rotation of the main arms 4 with respect to the vertical axis A and of the second arms 8 about the axis of rotation B, enables a wide range of sequences of movement to be obtained.

To control rotation of the second arm 8 with respect to the main arm 4 about the axis B, the roundabout is equipped with a device for detecting the relative position between them, such as, for example, an encoder.

On the basis of the relative position measured by the encoder, direction of rotation and speed of rotation of motor 10 can be appropriately controlled, to obtain the desired movement of the second arm 8 with respect to the main arm 4.

The vehicles can thus perform a series of complete rotations (or loops) about the axis of rotation B, which in combination with the motion of rotation about the vertical axis A of the main arms 4, brings about a helical movement of the vehicles on a toroidal surface.

By so doing, the roundabout offers the possibility of simulating the maneuver of acrobatic flight commonly known as "barrel roll," in which the aircraft follows a helical path with respect to the direction of advance. In other words, it is as if it were flying following the thread of a screw with constant diameter.

As a result of the structural features of the roundabout of the present invention, when the vehicles 7 perform a series of complete rotations (or loops) about the axis of rotation B, in combination with the motion of rotation about the vertical axis A of the main arms 4, the vehicle 7, and also the users carried therein, are subject to acceleration along the longitudinal axis z of the vehicle which are greater than or equal to zero.

Figure 5:
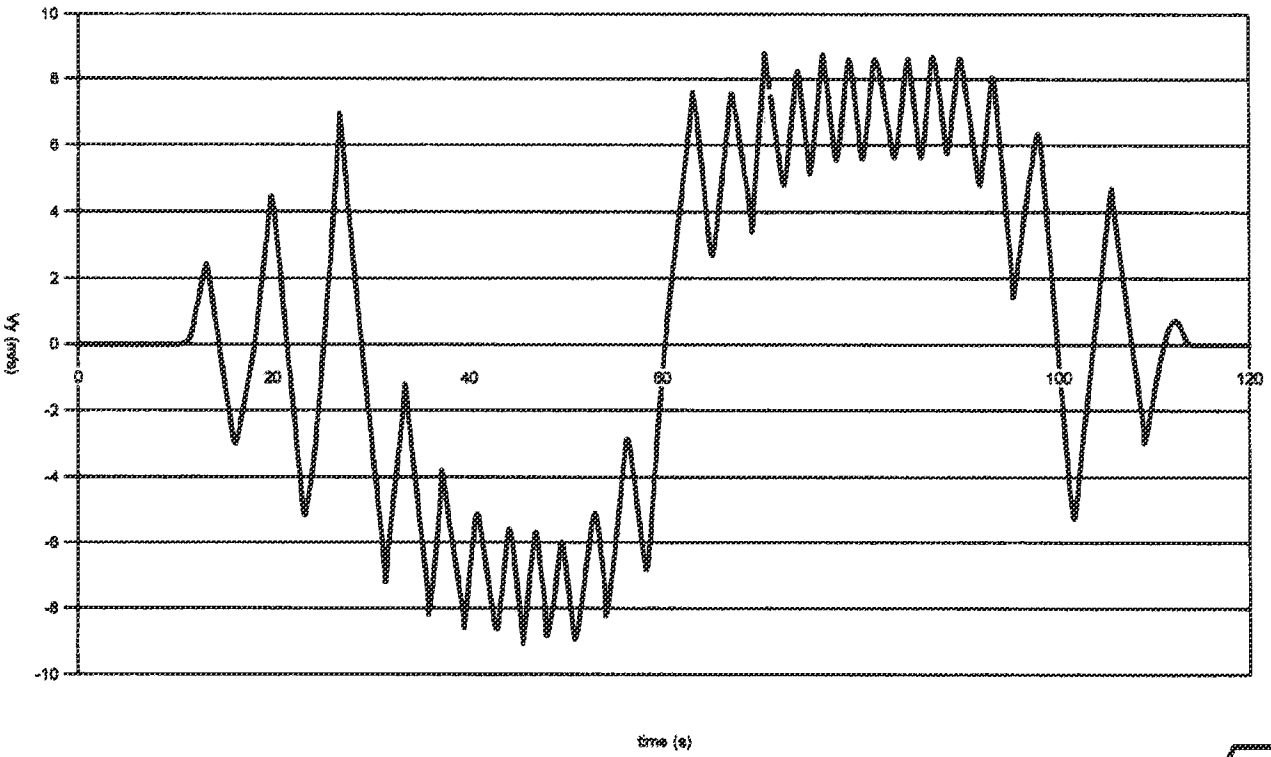
FIG. 5 is a graph that represents the lateral velocity acting on a vehicle of the roundabout according to the present invention.
Figure 6:
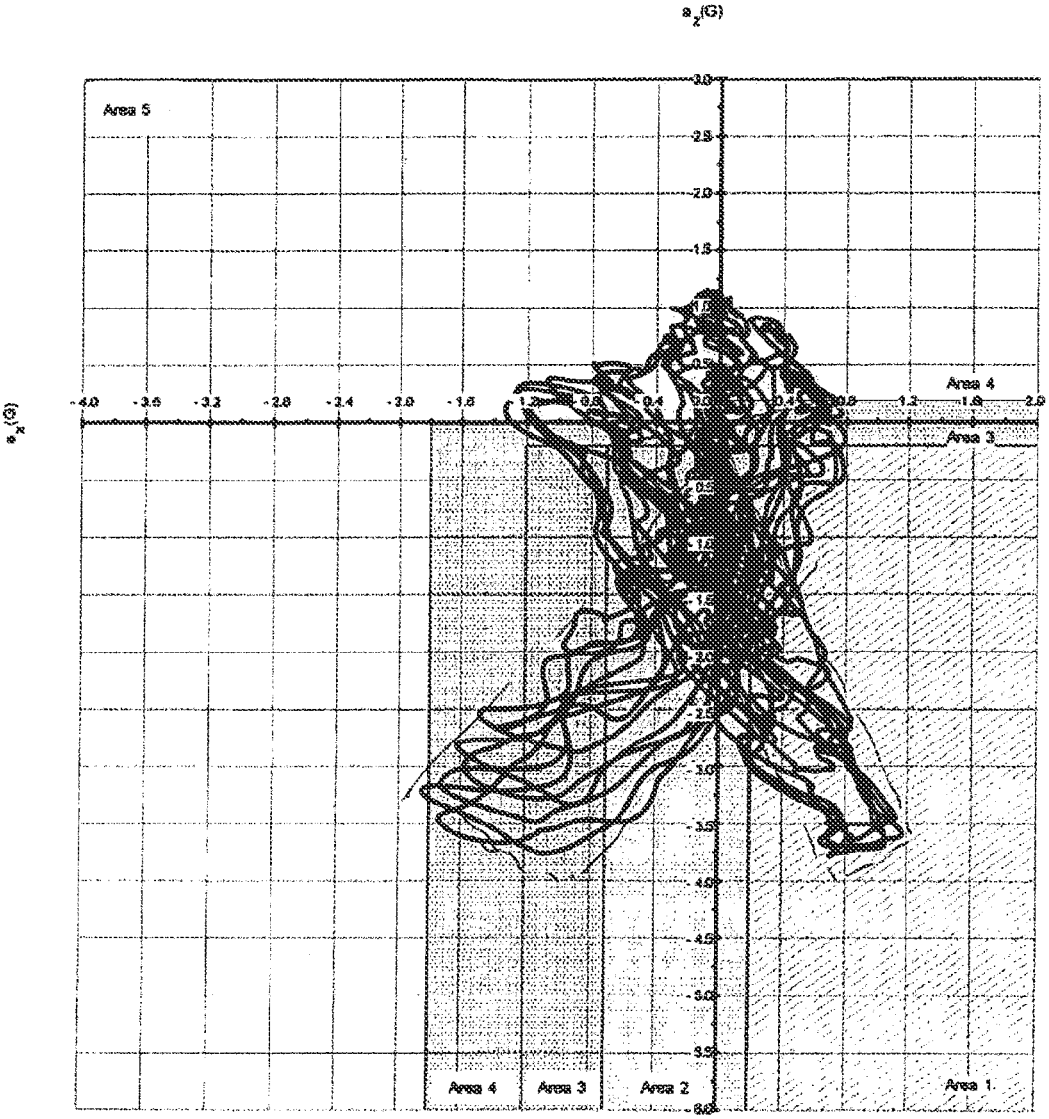
FIG. 6 is a diagram according to the ASTM F2291 standard that represents the accelerations acting on a vehicle of the roundabout according to the present invention.
Figure 7:
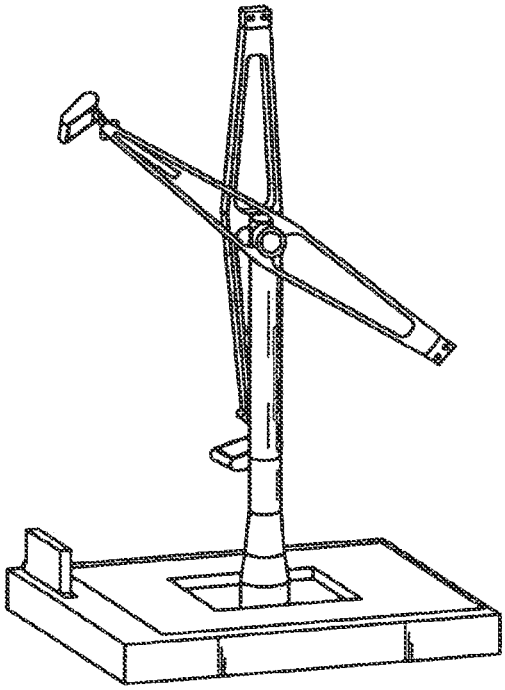
PRIOR ART Fig. 7
FIG. 7 is an example of the prior art.

FIGS. 5 and 6 show two graphs, showing the velocities and the accelerations acting on a vehicle of the roundabout according to the present invention in a period of time of two minutes of use, during which the vehicles, after some initial oscillations, perform a series of complete rotations about the axis B.

The velocities and accelerations represented in the graphs of FIGS. 5 and 6 are measured, by known devices, such as for example accelerometers, in a tri-axial reference system fixed with respect to the vehicle 7, the orientation of the set of three axes being shown in FIG. 4, represented in detail in which is a vehicle of the roundabout according to the present invention.

The reference system x-y-z fixed with respect to the vehicle 7, as shown in FIG. 4, having as origin the centre of gravity of the vehicle itself, enables approximation of the velocities and accelerations to which each individual user is subjected.

It is to be noted that in the exemplary embodiments shown in FIGS. 1 to 4, the users are carried on the vehicle with the headrest area 7.1 located closer to the axis of rotation B than the footrest area 7.2.

Thus, the longitudinal axis z of the vehicle corresponds, or is substantially parallel to, the axis passing trough the foot-head direction of the passengers, which is also directed radially towards the axis of rotation B.

In particular, the vehicle 7 represented in FIG. 4 can house four users on two rows of seats appropriately provided with retention mechanisms, but other embodiments of the vehicles are also possible that are designed to house a smaller or greater number of passengers.

FIGS. 5 and 6 show two graphs that represent, respectively, the lateral velocity ($v_y$) and the accelerations directed along z and x axis of the reference system defined above ($a_z$ and $a_x$), to which a vehicle 7 of the roundabout is subjected during a period of two minutes of a movement program, during which the vehicles carry out a series of complete rotations (loops), in both the clockwise and counterclockwise directions of rotation, with the initial and final transients of oscillation.

In FIG. 5, the plot of the lateral velocity $v_y$ of the vehicle, directed according to the axis y of the reference system of FIG. 4, shows how the vehicle, after some initial oscillations (identified by a reversal of the sign of the velocity, positive to negative, and vice versa), once it has reached a sufficient speed, performs a series of complete rotations (loops) about the axis of rotation B.

During the complete rotations of the vehicle 7 represented in the bottom part of the graph between approximately 30 and 60 seconds, the sign of the speed remains unvaried.

As previously stated, the control of the oscillations of the vehicle and of its speed of rotation about the axis B occurs by the motor 10 that is mounted on the main arm 4 and enables rotation of the second arm 8 with respect thereto. The reversal in the direction of rotation of the motor 10 enables further complete rotations (loops) of the vehicle in the direction opposite to the previous one. The new series of loops of the vehicle are identified in the top part of the graph of FIG. 5 between 60 and 100 seconds, during which the sign of the velocity remains unvaried.

Next, the motor 10 is preferably actuated in such a way as to get the vehicle to perform a series of oscillations about the axis of rotation B before reaching the position of rest.

In the example of sequence of movements just described with reference to FIG. 5, during the complete rotations, in both directions of rotation, the vehicle reaches a maximum lateral velocity of approximately 9 m/s.

Generally, the rotation velocity $\omega_B$ of the second arm 8 about the rotation axis B is regulated during the operation of the roundabout according to the mathematical relation $$\omega_B \geq \sqrt{\frac{g}{R_2}},$$

wherein g is the gravitational acceleration and $R_2$ is the length of the second arm 8, preferably measured from the axis of rotation B to the centre of gravity of the vehicle 7.

The rotation velocity $\omega_A$ of the main arm 4 about the rotation axis A is regulated in such a way that, without any imposed rotation of the second arm 8 about the rotation axis B, said second arm 8 reaches an equilibrium position, where $a_z$=max and $a_y$=0, in an angular position with respect to the vertical comprised in the range $0 \leq \theta_B \leq 45°$.

Angle $\theta_B$ is visible in the right portion of FIG. 1 and is measured from the vertical position of the second arm 8 in counterclockwise manner.

Furthermore, during the complete rotations of the vehicle 7 about the axis of rotation B, the roundabout according to the present invention is able to simulate the acrobatic maneuver called "barrel roll" and the vehicle 7, and also the users carried therein, are subject to acceleration along the longitudinal axis z which are greater than or equal to zero.

In fact, during the complete rotations (loops) of the vehicle 7 about the axis of rotation B the acceleration along z axis ($a_z$) of the vehicle 7 are greater than or at least equal to zero.

The graph of FIG. 6 represents the diagram according to the ASTM F2291 standard, commonly referred to as "Restraint Rose," widely used in the field of design of roundabouts and similar devices.

Represented therein are the accelerations along the axes x and z of FIG. 4, to which the vehicle is subject, which, as has been said, may vary a great deal both in terms of direction and in terms of intensity.

From the graph of FIG. 6 it may be noted that the higher accelerations are directed along the axis z of the reference system fixed with respect to the vehicle, as shown in FIG. 4, and vary during use in a range of between −1 g and +4 g. Negative values of acceleration along z axis are generated during the initial and final transients of oscillation of the second arm 8. During the complete rotations (loops) of the vehicle 7 about the axis of rotation B the acceleration along z axis ($a_z$) of the vehicle 7 are greater than or at least equal to zero.

Clearly visible in the graph of FIG. 6 is the fact that the accelerations along the axes x and z extend in all five areas into which the graph is divided (areas 1-5), and in particular the bottom part thereof is characterized by a conformation shaped like a V set upside down.

Said conformation highlights that, during use of the roundabout according to the present invention, the vehicle, and hence the users carried therein, are subjected to the joint action of high positive values (up to 4 g) of acceleration (along the axis z) and of accelerations (along the axis x) with values comprised in the range between −1.8 g and +1.2 g.

The invention claimed is:

1. A roundabout comprising:

at least one main arm movable along a path by at least one motor, the main arm having a longitudinal axis;

at least one second arm rotatably mounted on the at least one main arm and having an axis of rotation with respect to the at least one main arm;

at least one vehicle, having a vehicle longitudinal axis, mounted on the second arm in a position at a distance from the axis of rotation of the second arm with respect to the at least one main arm;

an actuator for rotating the second arm about the axis of rotation perpendicular to the longitudinal axis of the main arm to rotate the vehicle along a circular path in a plane perpendicular to the axis of rotation;

wherein the vehicle longitudinal axis of the at least one vehicle is directed towards the axis of rotation, and wherein the at least one vehicle is fixed to the second arm so that the position of the vehicle with respect to the second arm does not change during the operation of the roundabout.

2. The roundabout according to claim 1, wherein the vehicle has a headrest area and a footrest area, the headrest area being located closer to the axis of rotation than the footrest area.

3. The roundabout according to claim 2, wherein the vehicle has a backrest having a backrest longitudinal axis one of corresponding to or substantially parallel to the vehicle longitudinal axis.

4. The roundabout according to claim 1, wherein the at least one main arm is set radially with respect to the motor and moves along a main circular path in a substantially horizontal plane, and wherein the axis of rotation is tangential to the main circular path.

5. The roundabout according to claim 1, wherein the second arm is shorter than the main arm to allow the second arm to perform at least one complete turn with respect to the axis of rotation.

6. The roundabout according to claim 5, wherein the at least one main arm has a length between 3 m and 20 m.

7. The roundabout according to claim 5, wherein the second arm has a length between 2 m and 15 m.

8. The roundabout according to claim 1, further comprising:

a device for controlling movement of the second arm with respect to the main arm.

9. The roundabout according to claim 8, wherein the device for controlling the movement comprises an encoder for detecting a relative position between the second arm and the main arm.

10. The roundabout according to claim 1, wherein movement of the at least one vehicle in space occurs on a toroidal surface.

11. A method for operating a roundabout according to claim 1, comprising:

setting in rotation with respect to a vertical axis of rotation the at least one first main arm having the longitudinal axis directed radially with respect to the vertical axis of rotation; and simultaneously imposing complete rotation of the at least one vehicle fixed to the second arm with respect to the at least one main arm about the axis of rotation of the second arm, perpendicular to the longitudinal axis of the at least one main arm, the at least one vehicle being supported at the distance from the axis of rotation and being set in rotation along the circular path in the plane perpendicular to the axis of rotation and wherein the position of the vehicle with respect to the second arm does not change during the operation of the roundabout.

12. The method according to claim 11, wherein the rotations of the roundabout simulate a maneuver of acrobatic flight called "barrel roll."

13. The method according to claim 11, wherein the vehicle is fixed to the second arm and is subjected to accelerations along the vehicle longitudinal axis greater than or equal to zero.

* * * * *